US009146048B2

(12) United States Patent
Shelton

(10) Patent No.: US 9,146,048 B2
(45) Date of Patent: Sep. 29, 2015

(54) CHEMICAL STATE MONITOR FOR REFRIGERATION SYSTEM

(76) Inventor: Michael Shelton, Raleigh, NC (US)

( * ) Notice: Subject to any disclaimer, the term of this patent is extended or adjusted under 35 U.S.C. 154(b) by 807 days.

(21) Appl. No.: 12/980,493

(22) Filed: Dec. 29, 2010

(65) Prior Publication Data

US 2011/0088420 A1 Apr. 21, 2011

(51) Int. Cl.
*F25B 49/00* (2006.01)

(52) U.S. Cl.
CPC ..... *F25B 49/005* (2013.01)

(58) Field of Classification Search
CPC .... F25B 45/00; F25B 2400/16; F25B 49/005; F25B 43/006; F25B 39/04; F25D 3/045
USPC ..... 62/77, 127, 129, 149, 174, 292, 503, 62/509, 529; 702/1, 33, 34, 127, 182–185; 374/141–143, 45, 54, 4, 5
See application file for complete search history.

(56) References Cited

U.S. PATENT DOCUMENTS 2,181,855 A * 11/1939 McCloy ..... 62/77
3,600,904 A 8/1971 Tilney
4,553,400 A 11/1985 Branz
4,668,870 A 5/1987 Okura
4,856,288 A 8/1989 Weber
5,187,942 A 2/1993 Komatsu et al.
5,203,177 A 4/1993 Manz et al.
5,297,393 A 3/1994 Thompson
5,435,145 A 7/1995 Jaster
5,732,564 A 3/1998 Misawa et al.
5,752,390 A 5/1998 Hyde
6,047,559 A 4/2000 Tanaka et al.
6,508,067 B2 1/2003 Liu et al.
6,925,821 B2 8/2005 Sienel
2003/0172665 A1 * 9/2003 Matsuoka et al. ..... 62/149
2005/0103029 A1 * 5/2005 Kawahara et al. ..... 62/126
2005/0204756 A1 * 9/2005 Dobmeier et al. ..... 62/149
2007/0101759 A1 * 5/2007 Matsuoka et al. ..... 62/475
2007/0266717 A1 * 11/2007 Goodremote et al. ..... 62/149
2010/0089076 A1 * 4/2010 Schuster et al. ..... 62/77

* cited by examiner

*Primary Examiner* — Frantz Jules
*Assistant Examiner* — Azim Abdur Rahim
(74) *Attorney, Agent, or Firm* — Coats & Bennett, PLLC

(57) ABSTRACT

A chemical state monitoring system for a refrigeration system that continuously monitors and detects problems within a refrigeration system. The monitoring system comprises a sampling device for collecting refrigerant in a high pressure liquid line of the refrigeration system, a purge valve in an upper portion of the sampling device; a refrigerant state sensor for sensing a condition indicative of the state of refrigerant in the collection chamber; and a controller operatively connected to the refrigerant state sensor and to the purge valve for controlling said purge valve and detecting fault conditions based on signals from the sensor.

10 Claims, 7 Drawing Sheets

CHEMICAL STATE MONITOR FOR REFRIGERATION SYSTEM

BACKGROUND

The present invention relates generally to refrigeration systems and, more particularly, to a monitoring system for continuously monitoring the operating condition of a refrigeration system.

Refrigeration systems are used in a wide variety of applications for cooling and/or heating. Refrigeration systems often operate at less than maximum efficiency due to problems that arise during normal operation. Examples of potential problems include poor air flow across the evaporator or condenser, a frozen evaporator coil, a contaminated evaporator or condenser coil, low refrigerant levels, mechanical problems in the compressor, and faulty relays or other electrical components. When problems such as these arise, the refrigeration system may continue to operate, but with substantially reduced efficiency. The problem may not be detected for a long period of time resulting in increased energy consumption, increased cost of operation, and possible decrease in system life expectancy. Thus, detecting potential problems in a refrigeration system can result in substantial savings in energy and costs.

Accordingly, there is a need for a simple and inexpensive method and apparatus for early detection of problems in a refrigeration system that can adversely impact efficiency of operation.

SUMMARY

The present invention provides a chemical state monitor for a refrigeration system that can continuously monitor and detect problems in a refrigeration system. The invention is based on the observation that many basic problems in refrigeration systems manifest as too much vapor in the high pressure liquid line of the refrigeration system. Thus, many problems in the refrigeration system may be detected by monitoring the state of the refrigerant in the high pressure liquid line during normal operation. When excess vapor is detected in the high pressure liquid line, autonomous diagnostic tests can be performed to confirm a malfunction in the refrigeration system and thus avoid inefficient operation.

DETAILED DESCRIPTION

Figure 1:
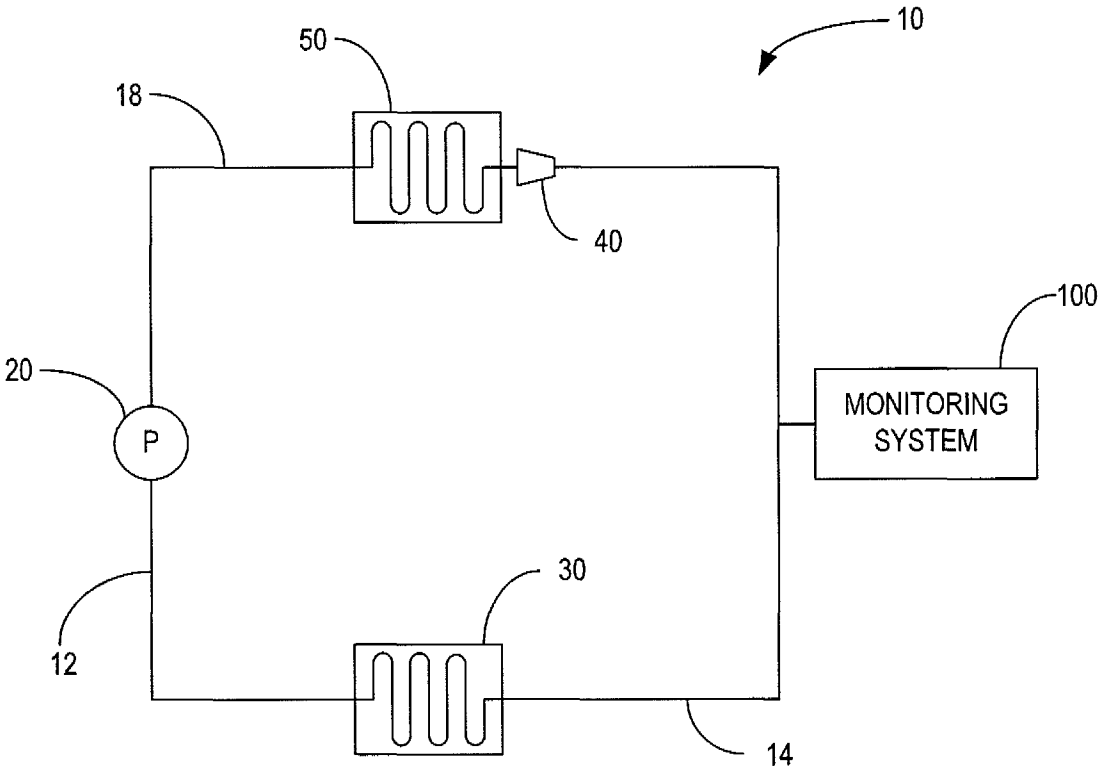
FIG. 1 illustrates an exemplary refrigeration system including a monitoring system according to the present invention.

Referring now to the drawings, FIG. 1 illustrates a refrigeration system 10 incorporating a monitoring system 100 according to one embodiment of the present invention. The refrigeration system 10 is a closed system including a compressor 20, condenser 30, metering device 40, and evaporator 50. During normal operation, the compressor 20 circulates a refrigerant, such as CFC, through the refrigeration system 10. The refrigerant enters the suction side of the compressor 20 as a low-pressure, low-temperature vapor. The compressor 20 compresses the refrigerant, which raises its temperature. The refrigerant exits the discharge side of the compressor 20 as a high-pressure, high temperature vapor. The high-pressure, high temperature vapor flows along high pressure vapor line 12 and enters the condenser 30. The purpose of the condenser 20 is to dissipate heat from the refrigerant into a cooling medium, such as air or water. As the temperature of the high pressure vapor drops, the refrigerant condenses and transitions to a liquid state. The refrigerant exits the condenser 30 as a high-pressure liquid while retaining some heat. The refrigerant flows along high pressure liquid line 14 and into the evaporator 50. As the refrigerant enters the evaporator 50, it passes through a metering device 40, which reduces the pressure of the refrigerant. As the pressure decreases, the temperature of the refrigerant drops below the temperature of the surrounding air. The purpose of the evaporator 50 is to cool the surrounding medium, such as air or water. As the refrigerant cools the surrounding medium, the refrigerant vaporizes and returns along low pressure vapor line 18 to the inlet of the compressor 20 as a low pressure vapor.

The monitoring system 100 as hereinafter described is disposed along the high pressure liquid line 14 between the condenser 30 and metering device 40. The main purpose of the monitoring system 100 is to detect the state of the refrigerant in the high pressure liquid line 14. During normal operation, the refrigerant in the high pressure liquid line 14 should be in a liquid state, with little or no vapor. Therefore, the presence of vapor in the high pressure liquid line 14 provides an indication that the system may not be operating at maximum efficiency. As will be hereinafter described, the monitoring system 100 collects refrigerant present in the high pressure liquid line 14 and detects fault conditions based on the state of the collected refrigerant. The monitoring system 100 thus enables early detection of problems that reduce the efficiency of the refrigeration system, including potential refrigerant loss due to leaks. Because some vapor may be present in line 14 due to normal use, a diagnostic test may be performed before generating an alarm signal to confirm the malfunction and avoid false alarms.

Figure 2:
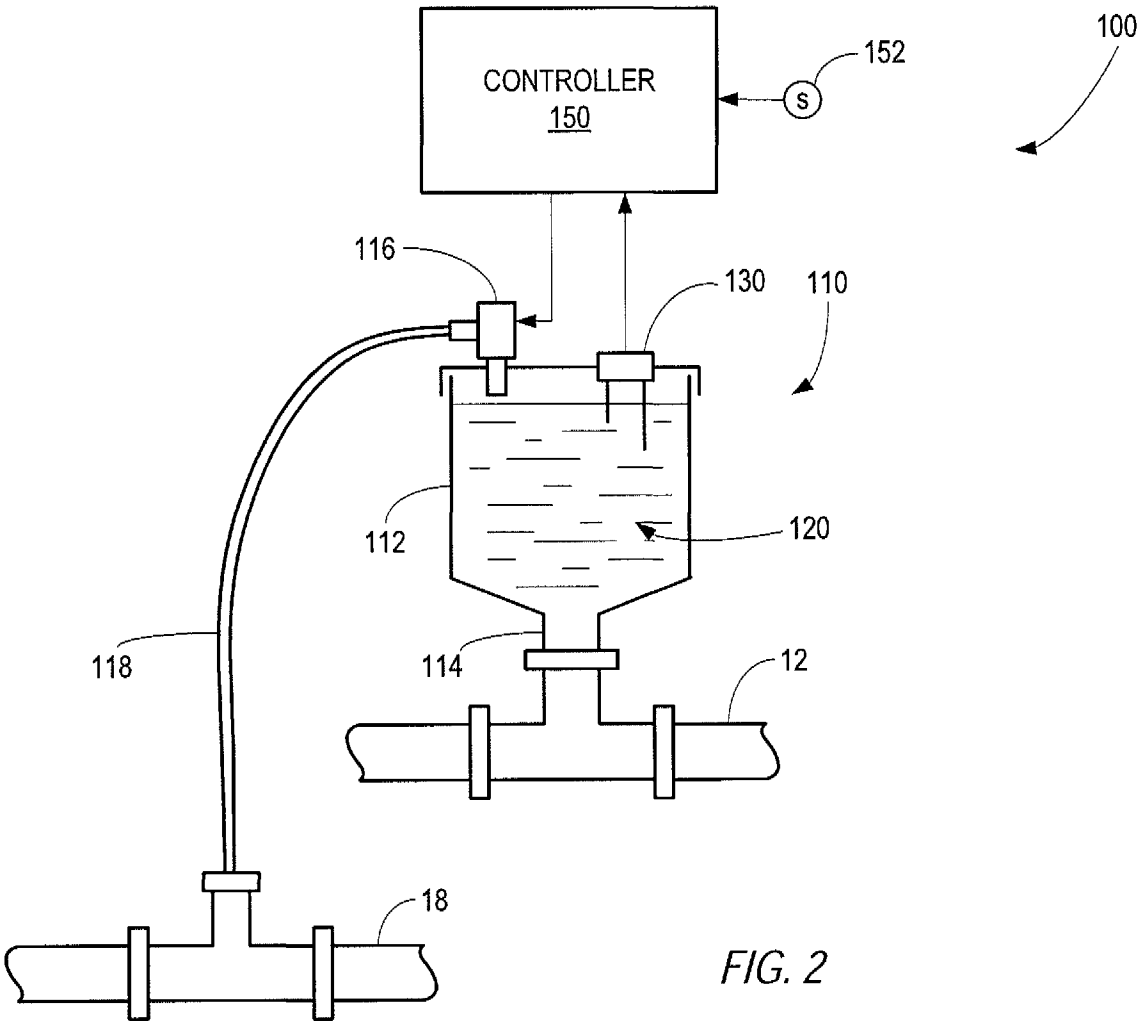
FIG. 2 illustrates an exemplary monitoring system according to a first embodiment for monitoring the chemical state of refrigerant in the refrigeration system.

FIG. 2 illustrates one exemplary embodiment of the monitoring system 100 in more detail. The monitoring system 100 comprises a sampling device 110 and controller 150. The sampling device 110 comprises a closed vessel 112 having an inlet 114 connected by a T-joint to the high pressure liquid line 14. A purge valve 116 is disposed in the upper portion of the sampling device 110 for purging vapor that becomes trapped in the sampling device 110. The purge valve 116 is connected by a purge line 118 to the low pressure line 14 of the refrigeration system.

The sampling device 110 extends vertically from the high pressure liquid line 14 outside the main flow of the refrigerant. The sampling device 110 includes a collection chamber 120 for collecting a sample of the refrigerant present in the high pressure liquid line 14. In normal operation, liquid refrigerant fills the collection chamber 120. If any vapor is present in the high pressure liquid line 14, the vapor collects in the upper portion of the collection chamber 120, which pushes the liquid refrigerant down. In the exemplary embodiment shown FIG. 2, a liquid level sensor 130 detects the liquid level in the collection chamber 120, which is indicative of the amount of vapor trapped in the upper portion of the collection chamber 120. The liquid level sensor 130 generates a signal which is monitored by the controller 150.

The controller 150 may comprise one or more processors, hardware, firmware, or a combination thereof. The controller 150 monitors the signal from the liquid level sensor 130. The controller 150 may also receive input from one or more sensors 152, such as a door sensor or current sensor. When the liquid level drops to a predetermined level, the controller 150 initiates a diagnostic test as hereinafter described to determine whether there is a problem in the operation of the refrigeration system 10. The purpose of the diagnostic test is to determine the state of the refrigerant in the high pressure liquid line 14 as a function of the liquid refrigerant level in the data collection chamber 120. If a problem is detected, the controller 150 generates an alarm to notify the owner that a problem may exists that effects the efficiency of the refrigeration system 10.

There are a number of fault conditions that may cause vapor to be present in the high pressure liquid line 14. Examples of potential problems include poor air flow across the evaporator or condenser, a frozen evaporator coil, low refrigerant levels due to a refrigerant leak, contaminated evaporator or condenser coils, mechanical problems in the compressor, and faulty relays or other electrical components. When problems such as these arise, the refrigeration system 10 may continue to operate, but with substantially reduced efficiency, resulting in longer run times for the compressor 20 and higher energy consumption. The problem may not be detected for a long period of time resulting in increased energy consumption, increased cost of operation, and possible decrease in system life expectancy. Thus, detecting potential problems in a refrigeration system 10 can result in substantial savings in energy and costs, as well as help protect the environment from harmful emissions if the cause turns out to be a refrigerant leak.

On the other hand, some conditions may arise during normal use that cause vapor to be present in high pressure liquid line 14. For example, opening the door of a refrigerator may result in warm air entering the conditioned space. The change in heat load may cause small gas bubbles to be present in the high pressure liquid line 14. Similarly, if the return air grill in an air conditioning system is located near an outside door, warm air may enter the evaporator 50, which can affect the heat load on the evaporator 50. Additionally, most systems are controlled by a thermostat so that the systems 10 do not operate continuously. That is, the compressor 20 is cycled on and off many times during the day. When the compressor 20 turns on, it may take several minutes for the refrigerant in high pressure liquid line 14 to reach a 100% liquid state.

The purpose of the diagnostic test is to differentiate between fault conditions and other "normal" conditions that may result in vapor within the high pressure liquid line 14. In the embodiment shown in FIG. 2, the diagnostic test is triggered when the liquid level within the collection chamber 120 drops below a predetermined level. Alternatively, the diagnostic test may be performed at a predetermined time interval or predetermined time of day. In general, the diagnostic test begins with the purging of vapor from the collection chamber 120. The controller then waits a predetermined time period and checks the liquid level in the collection chamber 120. Normal conditions that result in vapor in the high pressure liquid line 14 are typically transient. On the other hand, fault conditions are typically persistent. Therefore, the accumulation of vapor in the data collection chamber 120 after purging indicates that a malfunction may exist. The diagnostic test may be repeated a configurable number of times before generating an alarm signal to confirm that a system malfunction exists.

In some embodiments, the controller 150 may receive inputs from one or more sensors indicating normal conditions that may effect performance and perform the diagnostic test only when such conditions are present or not present. For example, the controller 150 may receive input from a door sensor indicating when a refrigerator door is open or a sensor indicating when the compressor 20 is enabled. In these cases, the diagnostic test is suspended when the refrigerator door is open or the compressor 20 is not running. The controller 150 may also implement a time delay function to allow sufficient time for the system 10 to reach a stable operating state before resuming the diagnostic test.

Figure 3:
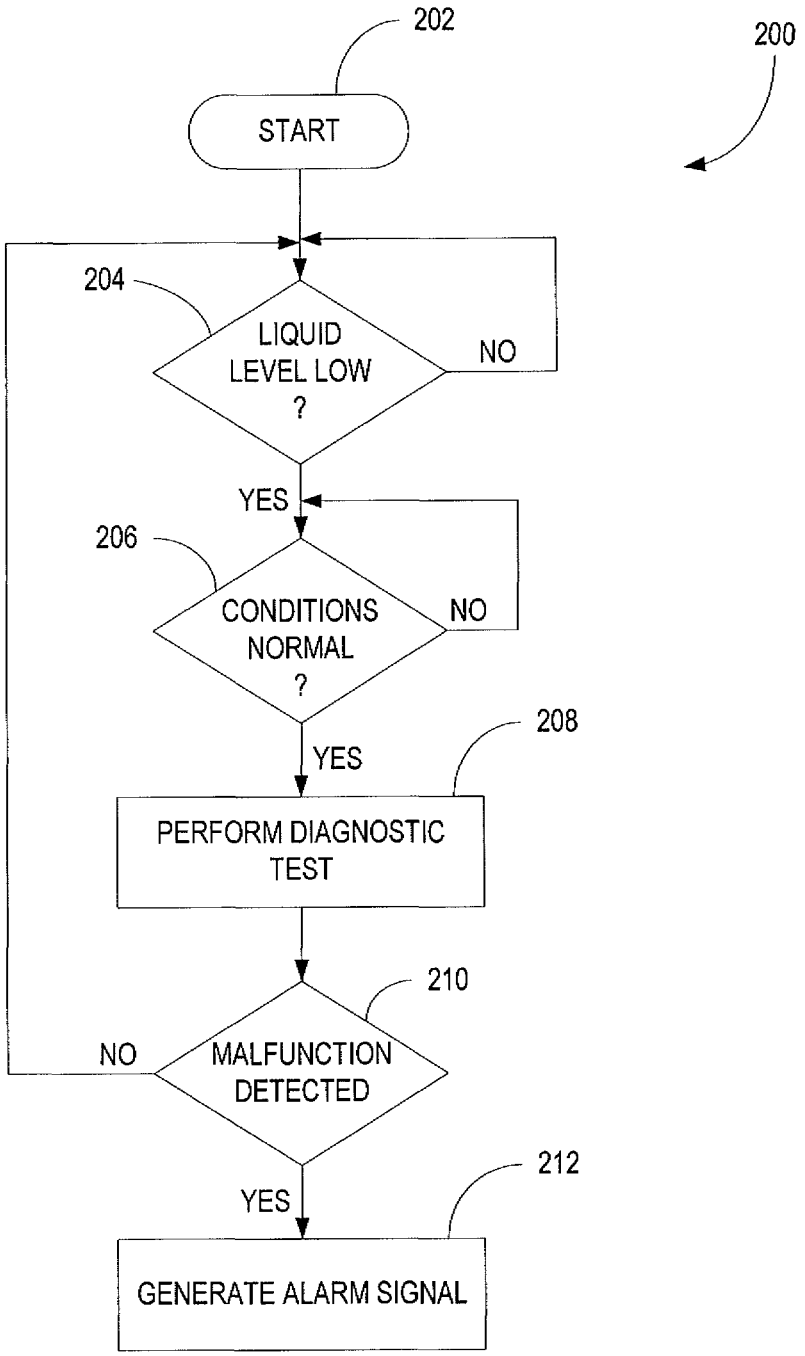
FIG. 3 illustrates an exemplary method according to the first embodiment of detecting malfunctions in a refrigeration system using chemical state monitoring.

FIG. 3 illustrates an exemplary procedure 200 performed by the controller 150 for monitoring the state of the refrigerant in the collection chamber 120. When the procedure starts (block 202), the controller 150 begins monitoring the liquid level in the collection chamber 120 (block 204). When the liquid level drops below a predetermined level, the controller 150 determines whether the operating conditions are normal (block 206). For example, the controller 150 may determine whether a refrigerator door is open and/or whether the compressor 20 is running based input from other sensors. If conditions are not normal, the controller 150 waits until the conditions return to a normal steady state and then performs a diagnostic test to determine the state of the refrigerant in the collection high pressure liquid line 14 (block 208). In the embodiments shown in FIG. 2, the level of the liquid refrigerant in the collection chamber 120 during normal operating conditions is indicative of the state of the refrigerant. Thus, the controller 150 may use measurements of the liquid level in the collection chamber 120 to determine the state of the refrigerant and detect malfunctions in the refrigeration system 10. If a malfunction is detected and confirmed by multiple tests, the controller 150 generates an alarm signal 212. The alarm signal may be used to illuminate a warning light and/or produce an audible alarm. If the monitoring system 100 includes communication capability, the monitoring system 100 may send an alert message to a predetermined address. For example, the monitoring system 100 could send a Short Message Service (SMS) message or email to a cell phone or home computer of a designated person, such as a home owner or service technician.

Figure 4:
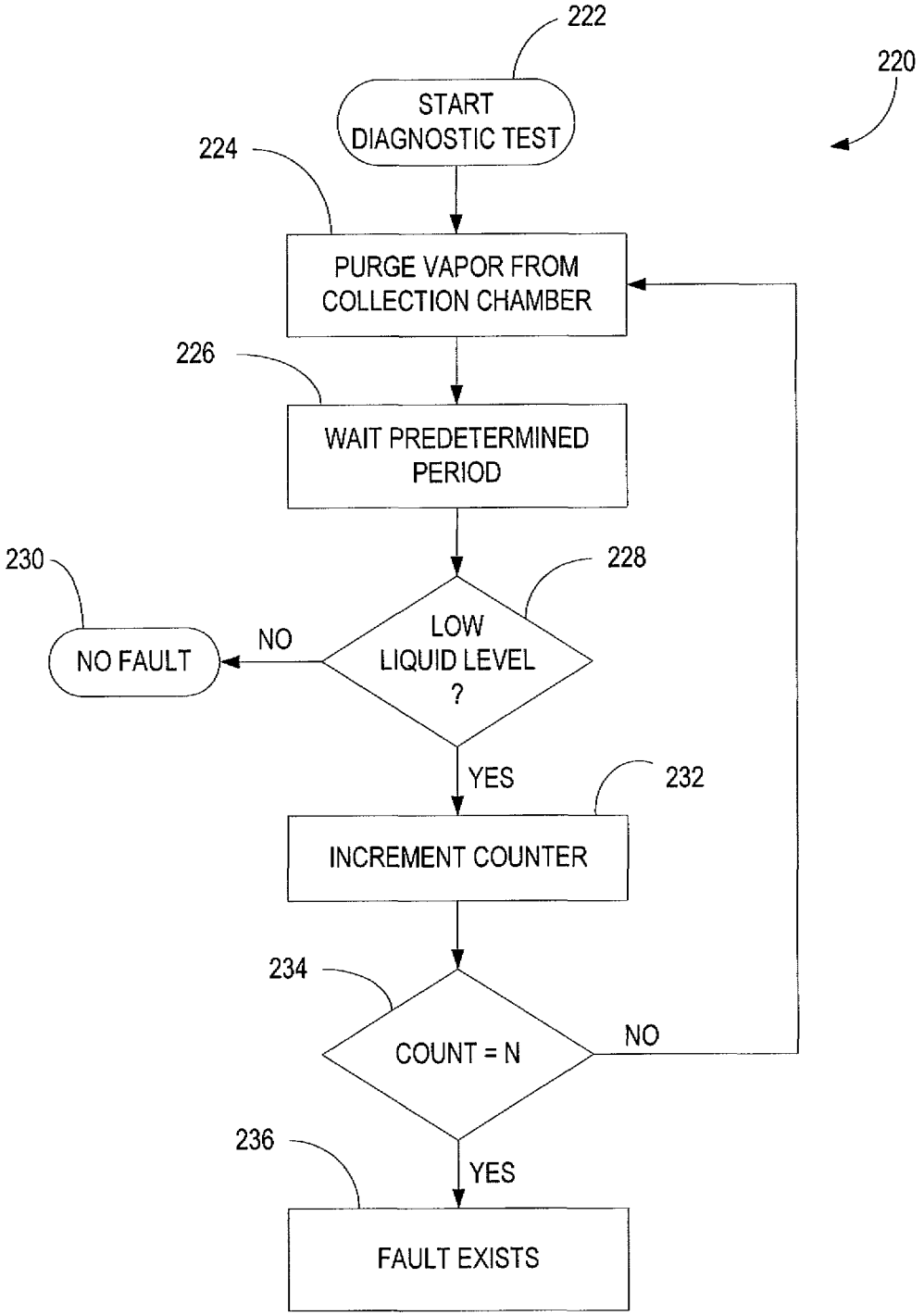
FIG. 4 illustrates an exemplary diagnostic routine according to the first embodiment for detecting a fault condition.

FIG. 4 illustrates in more detail a diagnostic routine 220 for determining the state of the refrigerant in the collection chamber 120. When the diagnostic routine 220 is triggered (block 222), the controller 150 generates a control signal to open the purge valve 116 and purge accumulated vapor from the collection chamber 120 (block 224). The purge valve 116 may be opened for a predetermined period of time (e.g., 5-10 seconds) or until the liquid refrigerant level rises to a predetermined level. After closing the purge valve 116, the controller 150 waits a predetermined time period (e.g., 60-90 seconds) (block 226), after which the controller 150 checks the liquid level in the collection chamber 120 (block 228). A high liquid refrigerant level after purging would indicate that conditions are normal. In this case, the controller 150 concludes that no fault exists and ends the diagnostic procedure (block 230). On the other hand, a low liquid refrigerant level due to the presence of vapor in the high pressure liquid line 14 may indicate a fault condition. In preferred embodiments, the purging and measuring operations (blocks 224-228) are repeated a predetermined number of times to confirm a fault condition. When the liquid refrigerant level drops after purging, the controller 150 increments a counter (block 232) and compares the accumulated count to a threshold (block 234). If the count is below the threshold, the controller 150 repeats the purging and measuring operations (blocks 224-228). If, after N repetitions, the liquid refrigerant level in the collection chamber 120 continues to drop, the controller 150 concludes that a fault condition exists (block 236).

Figure 5:
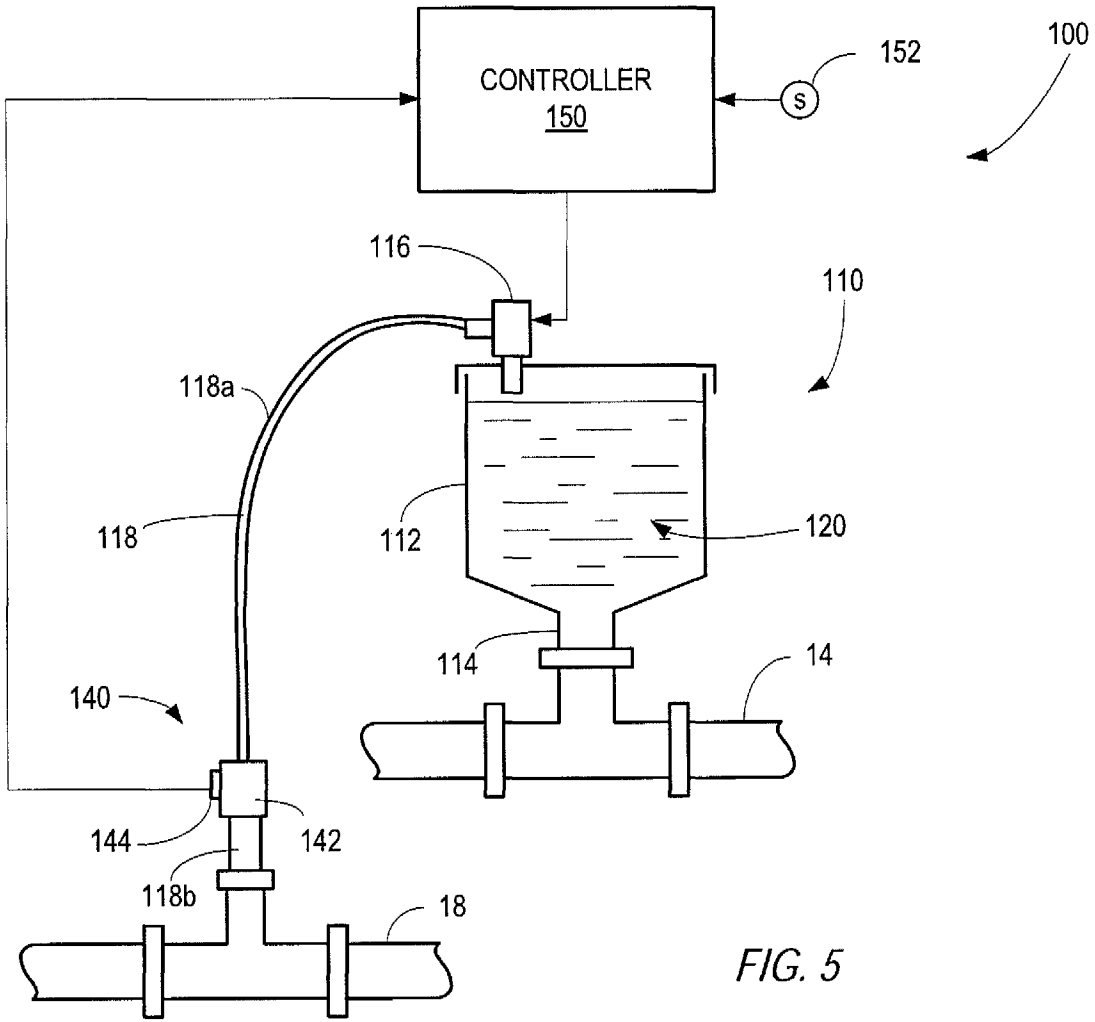
FIG. 5 illustrates an exemplary monitoring system according to a second embodiment for monitoring the chemical state of refrigerant in the refrigeration system.

FIG. 5 illustrates an alternate embodiment of the monitoring system 100. For convenience, similar reference numerals are used to indicate similar components in the two embodiments. The monitoring system 100 comprises a sampling device 110 constructed as previously described and a controller 150. The sampling device 110 comprises a closed vessel 112 having an inlet 114 connected by a T-joint to the high pressure liquid line 14 of the refrigeration system 10. A purge valve 116 is disposed in the upper portion of the sampling device 110 for purging vapor that becomes trapped in the sampling device. The sampling device 110 extends vertically from the high pressure liquid line 14 outside the main flow of the refrigerant and includes a collection chamber 120 for collecting vapor present in the high pressure liquid line 14.

The embodiment shown in FIG. 4 differs from the embodiment in FIG. 2 in that the liquid level sensor 122 is replaced by a thermocouple device 140 disposed along the purge line 118. The thermocouple device 140 comprises an expansion pipe 142 and thermocouple 144 for measuring the temperature of the refrigerant at the expansion pipe 142. The purge line 118 includes a first segment 118*a* extending from the purge valve 116 to the expansion pipe 142 and a second segment 118*b* extending from the expansion pipe to the low pressure line 18. The first segment 118*a* comprises a capillary with a small interior diameter (e.g., 1 mm), while the second segment 118*b* has a relatively large interior diameter (e.g., 12 mm). In this embodiment, the monitoring system 150 determines the state of the refrigerant in the collection chamber 120 by measuring the temperature of the refrigerant at the expansion pipe 142. To briefly summarize, when the purge valve 116 is open, refrigerant flows through the purge line segment 118*a* to the expansion pipe 142. If the refrigerant is in a liquid state, the temperature of the refrigerant will drop as it passes through the expansion pipe 142 and expands. On the other hand, if the refrigerant is in a vapor state or mixed state, the cooling effect will be less. Thus, the controller 150 is able to determine the state of the refrigerant by measuring the temperature at the expansion pipe 142.

Figure 6:
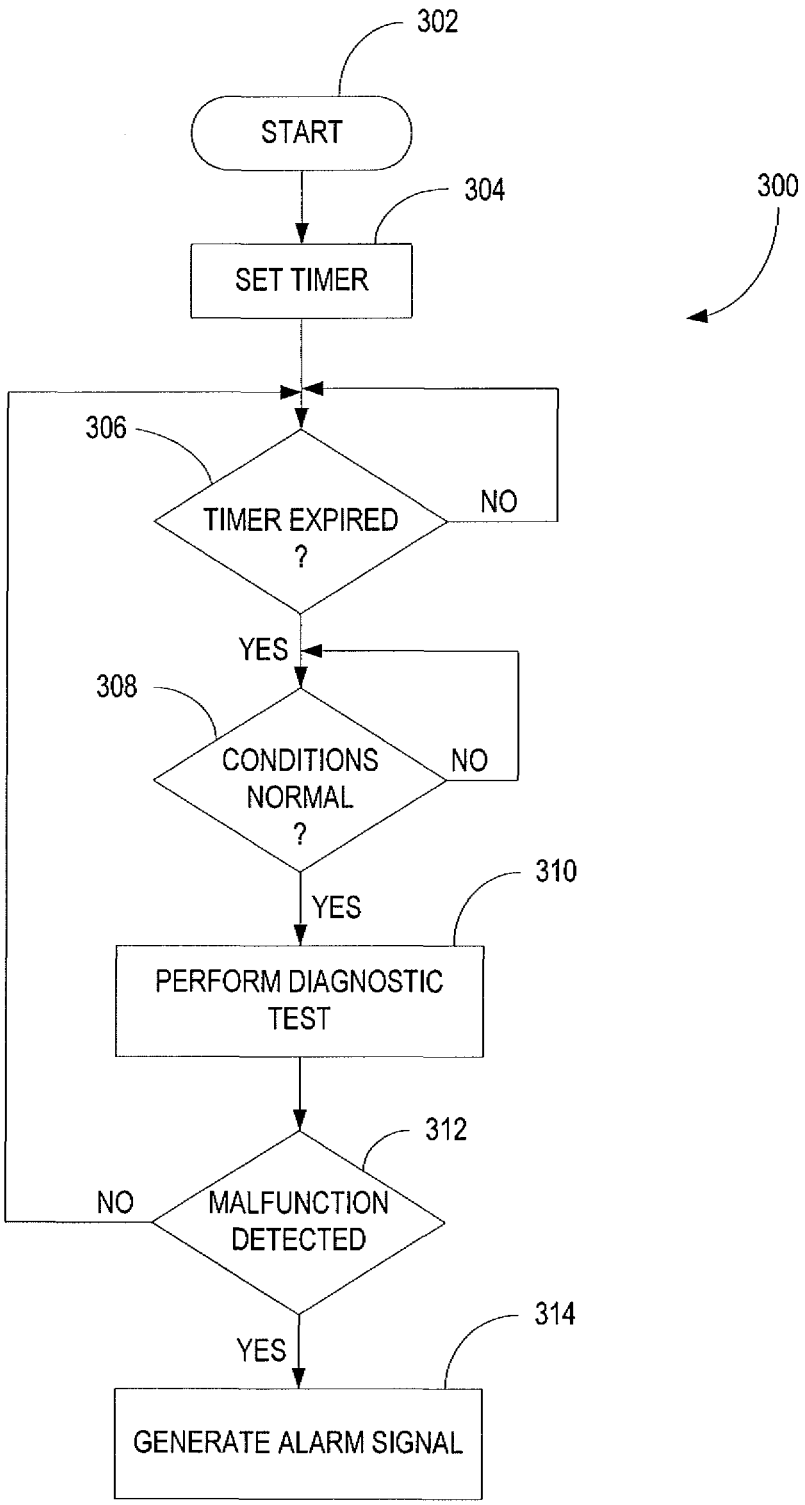
FIG. 6 illustrates an exemplary method according to the second embodiment of detecting malfunctions in a refrigeration system using chemical state monitoring.

FIG. 6 illustrates an exemplary procedure 300 performed by the controller 150 for monitoring the state of the refrigerant in the collection chamber 120. When the procedure starts (block 302), the controller 150 sets a timer (block 304). When the timer expires (block 306), the controller 150 determines whether the operating conditions are normal (block 308). If conditions are not normal, the controller 150 waits until the conditions return to a normal steady state and then performs a diagnostic test to determine the state of the refrigerant in the collection high pressure liquid line 14 (block 310). In the embodiment shown in FIG. 4, the temperature of the refrigerant in the expansion pipe 42 is indicative of the state of the refrigerant. Thus, the controller 150 may use measurements of the temperature to determine the state of the refrigerant and detect malfunctions in the refrigeration system 10. If a malfunction is detected (block 312), the controller 150 generates an alarm signal (block 314). The alarm signal may be used to illuminate a warning light and/or produce an audible alarm. If the monitoring system 150 includes communication capability, the monitoring system may send an alert message to a predetermined address. For example, the monitoring system could send a Short Message Service (SMS) message or email to a the cell phone or home computer of a designated person, such as a home owner or service technician.

Figure 7:
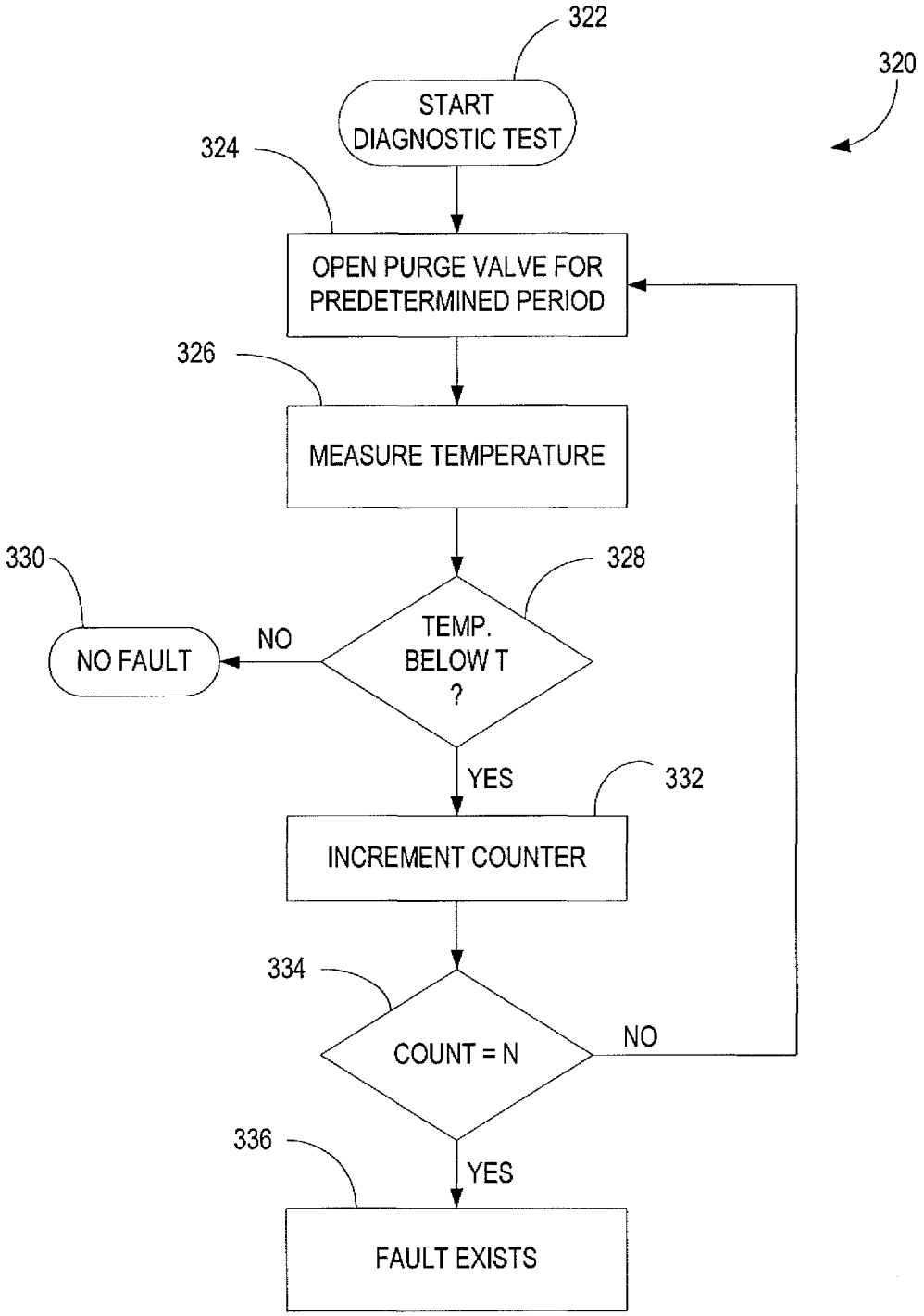
FIG. 7 illustrates an exemplary diagnostic routine according to the second embodiment for detecting a fault condition.

FIG. 7 illustrates in more detail a diagnostic procedure 320 for determining the state of the refrigerant in the collection chamber 120. When the diagnostic procedure 320 is triggered (block 322), the controller 150 generates a control signal to open the purge valve 116 for a predetermined period of time (e.g., 5-10 seconds) to discharge refrigerant in an unknown state into the purge line 118 (block 324). During the purge process and after closing the purge valve 116, the controller 150 measures the temperature of the refrigerant at the expansion pipe 142 (block 326) and compares the measurement to a threshold T (block 328). A low temperature measurement, i.e., below the threshold T, after purging would indicate that the refrigerant is liquid while a high temperature measurement, i.e., above the threshold T, indicates that the refrigerant contains some vapor. The threshold T may be configurable and some empirical testing may be needed to determine the appropriate setting for the threshold T. If the temperature is below the threshold T, the controller concludes that there is no fault (block 330). On the other hand, a high refrigerant temperature due to the presence of vapor in the high pressure liquid line 14 may indicate a fault condition. In preferred embodiments, the purging and measuring operations (blocks 324-328) are repeated a predetermined number of times to confirm a fault condition. After each iteration, the controller 150 increments a counter if the temperature is above the threshold T (block 332) and compares the accumulated count to a threshold (block 334). If the count is below the threshold, the controller 150 repeats the purging and measuring operations (blocks 324-329). After N high temperature measurements, the controller 150 concludes that a fault condition exists (block 336).

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A monitoring system for a refrigeration system, said monitoring system comprising:

a sampling device having an inlet connecting to a high pressure liquid line in a refrigeration system and a collection chamber to collecting refrigerant present in the high pressure liquid line, said sampling device extending vertically from the high pressure line outside the main flow of the refrigerant so as to trap vapor during normal operation;

a normally closed purge valve in an upper portion of the collection chamber for purging refrigerant from the collection chamber, said purge valve connected to a low pressure line of the refrigeration system; and a refrigerant state sensor for sensing a condition indicative of the state of refrigerant in the collection chamber;

a controller operatively connected to the refrigerant state sensor and to the purge valve, said controller configured to:

open the purge valve during normal operation for a predetermined period of time to discharge refrigerant from the collection chamber;

detect the state of the refrigerant discharged from the collection chamber as the refrigerant passes through an expansion pipe; and detect a fault condition based on the detected state of the refrigerant discharged from the collection chamber.

2. The monitoring system of claim 1 wherein the refrigerant state sensor comprises a temperature sensor for measuring the temperature of refrigerant discharged from the collection chamber and wherein the controller determines the state the refrigerant as a function of the refrigerant temperature.

3. The monitoring system of claim 1 wherein the controller is further configured to generate an alarm signal if a fault condition is detected.

4. The monitoring system of claim 1 further comprising one or more sensors providing input to the controller and wherein the controller is configured to suspend fault detection responsive to signals from said one or more sensors.

5. The monitoring system of claim 4 wherein said one or more sensors comprises at least one of a door sensor for sensing when a door in a conditioned space is opened and a sensor for detecting when a compressor in the refrigeration system is enabled.

6. A method of detecting a fault condition in a refrigeration system, said method comprising:

collecting refrigerant in a high pressure liquid line of the refrigeration system in a collection chamber of a sampling device during normal operation of the refrigeration system, wherein said sampling device includes an inlet connected to the high pressure liquid line and extends vertically from the high pressure line outside the main flow of the refrigerant so as to trap vapor during normal operation; and opening a purge valve in an upper portion of the collection chamber during normal operation for a predetermined period of time to discharge refrigerant from the collection chamber;

detecting a fault condition by detecting the state of the refrigerant discharged from the collection chamber.

7. The method of claim 6 wherein detecting a fault condition comprises:

measuring the temperature of the refrigerant discharged from the collection chamber as the refrigerant passes through an expansion pipe; and determining the state of the refrigerant as a function of the temperature.

8. The method of claim 6 further comprising generating an alarm signal if a fault condition is detected.

9. The method of claim 6 further comprising suspending fault detection responsive to signals from one or more sensors.

10. The method of claim 9 wherein said one or more sensors comprises at least one of a door sensor for sensing when a door in a conditioned space is opened and a sensor for detecting when a compressor in the refrigeration system is enabled.

* * * * *